United States Patent [19]

Shelton

[11] 4,163,949

[45] Aug. 7, 1979

[54] TUBISTOR

[76] Inventor: Joe Shelton, 700 Tatom St., NW., Hunstville, Ala. 35805

[21] Appl. No.: 864,349

[22] Filed: Dec. 27, 1977

[51] Int. Cl.[2] ..... H01J 29/00; H01J 1/02

[52] U.S. Cl. ..... 328/254; 313/302; 313/309; 313/351

[58] Field of Search ..... 313/302, 309, 336, 351, 313/303; 328/254, 255

[56] References Cited

U.S. PATENT DOCUMENTS

| | | | |
|---|---|---|---|
| 2,287,749 | 6/1942 | Slayter | 313/309 X |
| 3,453,478 | 7/1969 | Shoulders et al. | 313/336 X |
| 3,665,241 | 5/1972 | Spindt et al. | 313/309 X |
| 3,745,402 | 7/1973 | Shelton et al. | 313/336 X |
| 3,746,905 | 7/1973 | Shelton et al. | 313/309 |
| 3,783,325 | 1/1974 | Shelton | 313/336 |
| 3,840,955 | 10/1974 | Hagood et al. | 29/25.18 |
| 3,859,550 | 1/1975 | Hagood et al. | 313/309 |

*Primary Examiner*—Alfred E. Smith
*Assistant Examiner*—Charles F. Roberts
*Attorney, Agent, or Firm*—Nathan Edelberg; Robert P. Gibson; Freddie M. Bush

[57] ABSTRACT

The tubistor is a device which incorporates features of both electron tubes and solid state devices such as a transistor and includes extremely close spacing between the multiple conducting elements of the device. The tubistor comprises a section of an oxide-metal composite that has been ion milled to produce inverted cones in the oxide with the emitting metal fibers at the bottom. A conducting layer deposited on the insulating layer surface forms a type of grid. A collector or anode disposed above the grid collects electrons emitted from the emitter when the appropriate potentials are applied to the device.

9 Claims, 8 Drawing Figures

TUBISTOR

DEDICATORY CLAUSE

The invention described herein may be manufactured, used, and licensed by or for the Government for governmental purposes without the payment to me of any royalties thereon.

SUMMARY OF THE INVENTION

The tubistor includes a grown oxide-metal composite consisting of at least a million individual emitting points in each square centimeter of material with control elements closely spaced such that field emission occurs. In operation the electrons travel through an evacuated space as in an electron tube, but the current versus applied voltage characteristics are similar to those associated with transistors since the mechanism for releasing the electrons, the reduction of the potential barrier, is common to both field emitters and transistors. The tubistor depends on the extremely close spacing between grid or anode and the emitting points for its operation which results in several advantages. Since the distance between the emitter and the anode has been decreased from near 0.1 centimeter to near $10^{-4}$ centimeter, as compared to prior art devices, the time required for the electron to travel from emitter to collector is reduced in the same ratio for a given voltage, thus extending its use. The close spacing also reduces the probability that the electron will collide with a gas molecule while traveling from emitter to collector for any given pressure. This results in the production of fewer ions in the space that could possibly damage the emitter. By segmenting the grid or the emitter such that each section is isolated from the other section a tubistor can easily integrate or mix hundreds of signals in one small device.

DESCRIPTION OF THE PREFERRED EMBODIMENT

Figure 1:
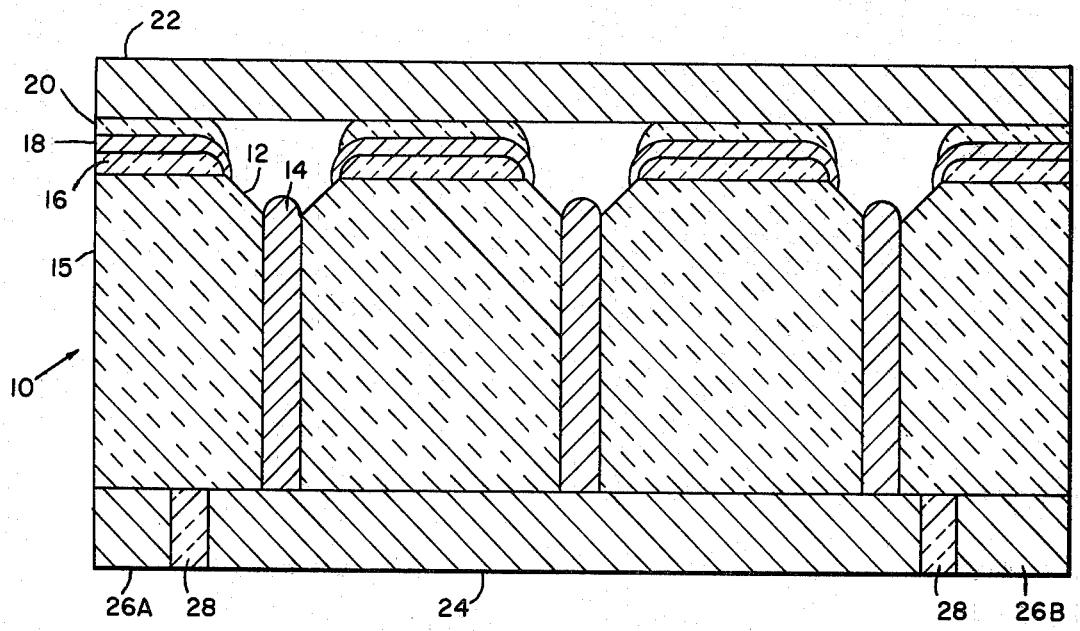
FIG. 1 is a diagrammatic, sectional view of a typical tubistor composite.

The tubistor depends on the extremely close spacing between the grid or anode and the emitting point for its operation which results in several advantages. In the past, spacing of this small size, in the micron ($10^{-4}$ centimeters) range could not be achieved both because of material limitations and the fact that the control grid or anode would be operating within the electron cloud. In addition, the heat that evolves from the thermionic emitter would quickly distort or destroy conventional grids. FIG. 1 shows a section of a melt-grown oxide-metal composite 10 that has been ion milled to produce inverted cones 12 in the oxide with the emitter or emitting fiber 14 at the bottom of the cone and insulating layer 16 is deposited on the surface of the oxide 15 while the material is rotated at an angle to the deposition source. A conducting layer is then deposited on the insulating layer to form a type of grid 18 or control electrode. In a similar manner an insulator 20 may be deposited on grid 18. Subsequently an anode or collector 22 may be placed on insulator 20 to provide a triode type of construction. A backing plate 24 for the oxide-metal composite provides electrical contact between a power source and the emitting fibers. A single oxide-metal composite may have separate conductive backing plates 26, such as plates 26A and 26B, adjacent the backing plate 24 and separated therefrom by respective insulators 28 providing a multi-emitter device. The respective insulating and conductive layers are deposited at some controlled thickness to provide the desired insulation at an angle that does not fill the cone. The device may be placed in a vacuum chamber for operation. Obviously this type of construction can be used to develope a diode, triode, multi-grid or multi-anode structure. Where the oxide-metal composite 10 has the required electrical characteristics to provide insulation between the emitting fibers and a conductive grid, the first insulating layer 16 can be omitted.

The tubistor is a field effect device capable of providing low voltage or high voltage operation depending on the spacing between emitting fibers and the other corresponding conducting elements of the device. Its operation includes characteristics of both the electron tube and the transistor, while it is neither tube nor transistor. The tubistor has a characteristic curve similar to that of transistors, its physical characteristics are similar to transistors. It has the ability to operate at ambient temperatures and to respond instantly upon application of power. Similarly to the electron tube, it has the same mechanism for electron transport, through an evacuated space, it is capable of withstanding the temperature extremes of electron tubes, and it is less subject to radiation damage than a solid state device. The close spacing between elements, near one micron, results in a very short transient time for the electron as it moves from the emitter to the anode. It also allows operation at a higher pressure and thus would extend the storage life of the device as compared to conventional electron tubes, all other factors being equal.

Figure 5:
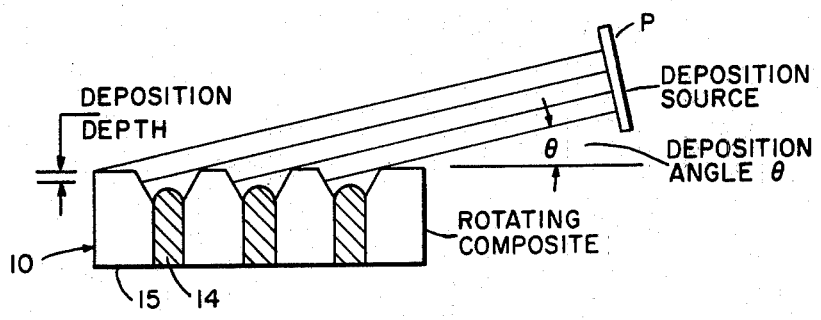
FIG. 5 is a diagrammatic view of an oxide-metal composite disposed for rotation at an angle with respect to a deposition source for depositing alternate layers of insulation and conductive material on the composite.
Figure 6:
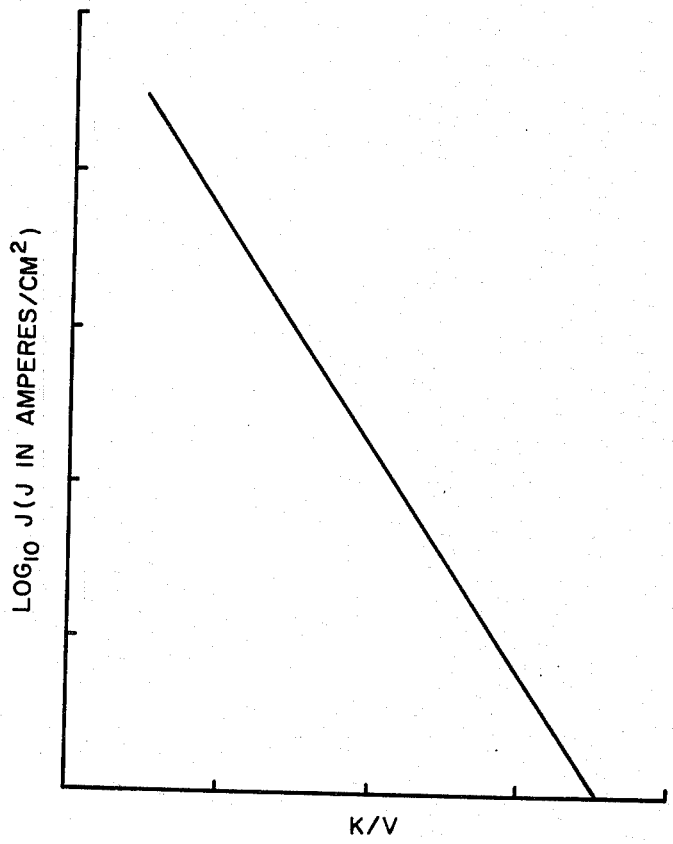
FIG. 6 is a graph of a typical Fowler-Nordheim graph for field emitters.

Fabrication of the tubistor consists of three basic steps. The first step consists of preparing the basic oxide-metal composite. This material is grown at temperatures in excess of 2000° Centigrade in established prior art procedures and consists of parallel metal rods embedded in an insulating oxide. Construction of oxide-metal composites is disclosed in detail in "Melt-Grown Oxide-Metal Composites Report, No. 6" by A. T. Chapman et al, Georgia Institute of Technology, 1973. The material is sliced to the desired thickness and is used as the field emitter for the tubistor. Each square centimeter of the material contains an excess of one million parallel rods with each having a diameter of less than one micron. The material is then ion milled to form the basic emitter structure. The ends of the rods are rounded by standard etching techniques to ensure uniform emission from rod to rod. The angle of the opening in the oxide is determined by the angle at which the composite is placed in relation to the ion milling source. Typically, as shown in FIG. 5, after the basic composite 10 has been ion milled and the emitting points of rods 14 rounded, the control circuits are plated on the insulating oxide. If the device is to be used as a diode, a flat conducting plate is placed on the oxide, appropriate leads attached, and the device is evacuated and sealed in a container. If a control element is to be used, a conducting film and then an insulating film is placed on the composite. The plating is done with a plating source P placed at an angle $\theta$ to the composite and the composite rotated while the plating is being done. The angle chosen determines the distance below the oxide surface that the plating material reaches as shown typically in FIGS. 1 and 5. The operation of the tubistor is typically that of a close spaced multipoint field emitter. The current density from each emitting point follows the Fowler-Nordheim curves. A typical plot of the log of the current density versus the reciprocal voltage is shown in FIG. 6. The electric field at each emitting point is given by the equation $$F = K\frac{VA^{\frac{1}{2}}}{ad}$$

where V is applied voltage, a is the spacing between the control element and emitter, A is the area of the control element seen by the emitting point, and d is the diameter of the emitting tip. In general the diode characteristic curve is similar to a solid state diode curve and the triode characteristic curve will be similar to the curve for a field effect transistor. The effects of work function and possible thermionic-field emission on the total emission follows the data available for single point emitters.

Actual operation of a field effect device requires electric fields in excess of $10^7$ volts/centimeter these high fields are attained in the normal field effect devices by using very small emitting points and voltages in the kilovolt range. The tubistor will normally operate at less than 100 volts which is possible due to the extremely close spacing between the control electrode and the emitting point, and the ratio of the square root of A to d, known as the field multiplication factor. For a field multiplication factor of 10 and a spacing of one micron, the field at the emitting tip is $10^7$ volts per centimeter for a potential of 100 volts. Current has been achieved from a plated, close spaced device at voltages as low as 8 volts. The spacing between the control device and emitter can be changed by changing the angle of deposition, and the field multiplication factor can be changed by changing the ion milling angle, thus at least two physical parameters may be varied to control the operating voltage versus current characteristics of the tubistor.

In prior art transistor or vacuum tube devices the usual approach to providing multiple inputs is to stack additional control girds or control electrodes on the existing grids of the device. However this approach is limited to only a few grids and quickly begins to degrade the device performance. This is also true in the tubistor since the electron transit space quickly increases. However the tubistor can easily integrate or mix hundreds of signals in one small device by segmenting either the grid or the emitter such that each section is isolated from the other section, as shown typically in FIG. 2. For the sectioned emitter 10, the back side of the emitter 11 is attached to an oxide 28 having holes therein which are filled with the conducting material 24 or 26 to which input leads are attached for providing the individual conducting sections. Where the grid 18 is sectioned instead of the emitter, the sectioning is limited to either a pie shaped or strip line section such that electrical connections can be made to the respective ends or edges of the sections since the grid surface would be inaccessible without interferring with electron flow. A sectioned grid is shown, typically, in FIG. 2 with a strip of insulation 19 separating grid 18 into segments forming isolated grid sections, for providing a plurality of individual grids. Similarly, a multi-anode structure may be used with insulation strips 23 or other shaped insulation separating sections of the anode 22 for providing a plurality of separate and distinct collectors. Obviously, the multi-anode and multi-grid structure can be operated just as an unsectioned anode or grid structure simply by supplying the same anode and grid potentials to the appropriate anode segments 22 and grid segments 18.

Figure 2:
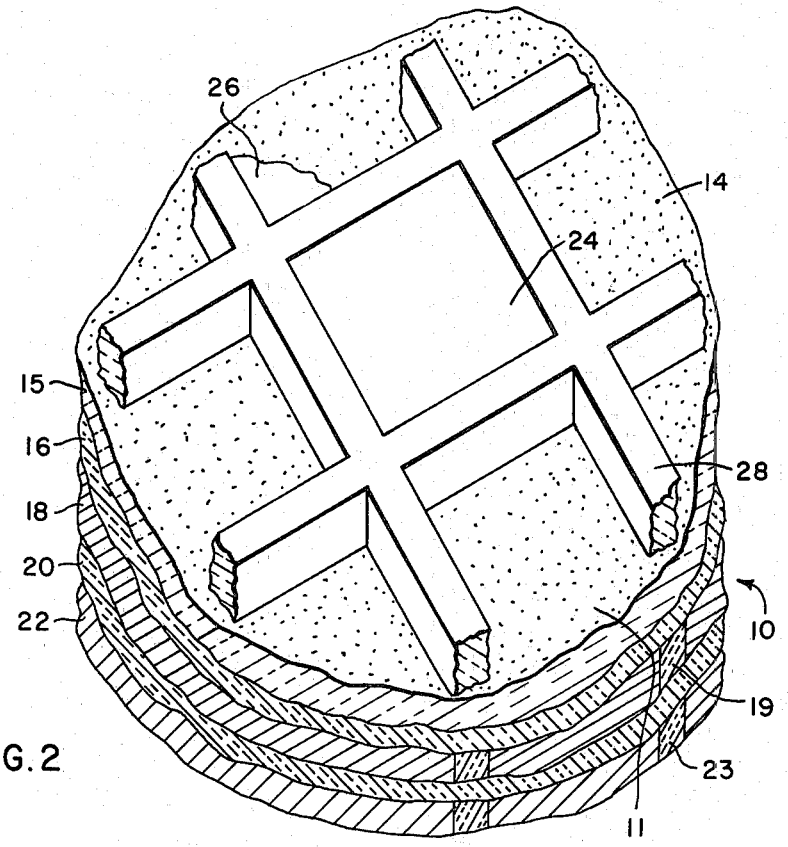
FIG. 2 is a diagrammatic view of one section of a typical segmented emitter vacuum plate.
Figure 3:
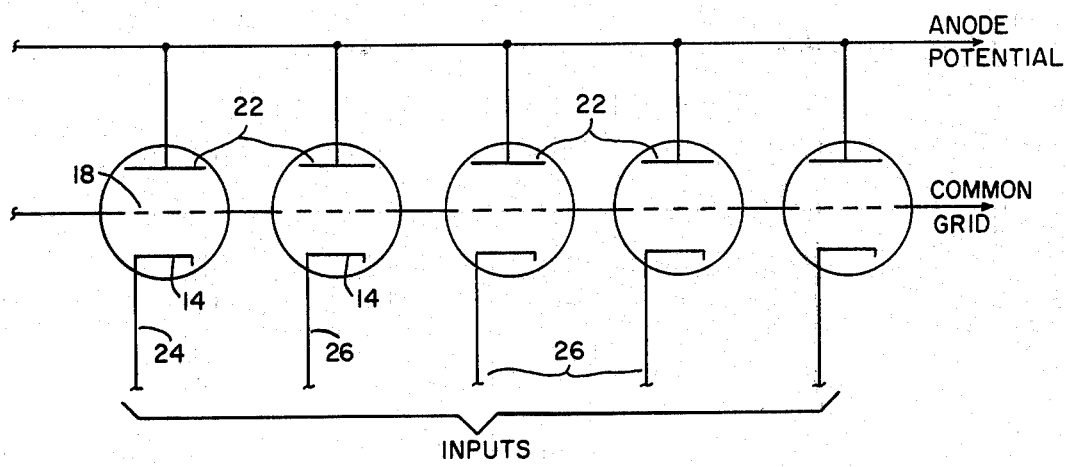
FIG. 3 is a schematic of the equivalent circuit of a plurality of segmented emitter circuits.
Figure 4:
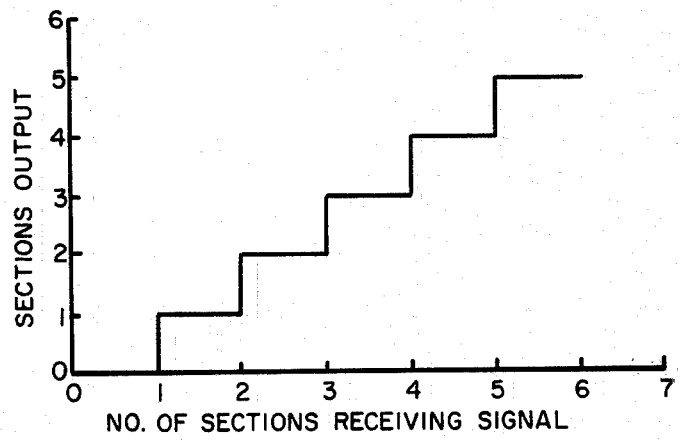
FIG. 4 is a graph showing the output signal from a sectioned emitter tubistor as a function of a number of signals input to the emitter section.

In operating the multi-controlled structure of FIGS. 1 and 2 the grid is maintained at some potential with regard to the emitter such that a signal input to the emitter would result in current flow to the anode as in a conventional device. The sectioned emitter allows the tubistor to be operated as a group of triode electron tubes with a common control grid and the input signals being introduced through the emitters or cathodes. This is schematically shown in FIG. 3. In FIG. 3 the cathodes 14 are shown coupled to respective inputs 24 and 26 for providing input signals. The unsectioned grid 18 serves as a common grid to all of the emitters 14. The unsectioned anode 22 serves as a single collector for the individual emitters. With the anode potential applied and a common grid potential, application of input signals in any desired order to the emitters will result in a composite output which is a function of the number of input signals received as, typically, may be seen in FIG. 4. FIG. 4 shows the typical output for a sectioned or segmented emitter structure for five sections sequentially becoming conductive and each remaining conductive as subsequent stages become conductive.

For alternating signals, the operation is similar to that of a multi-grided mixer tube, except that many more signals can be mixed. Each signal to be mixed is introduced through one or more sections of the emitter and the composite signal will be present at the anode or collector. More elaborate devices can be easily designed by using state of the art technology. For example, the anode or collector can be sectioned in such a manner as to match the sections of the emitter which results in many independent sections in the same basic device. Further still, the anode, grid, and emitter can be sectioned such that they all match which results in numerous completely isolated devices within the same basic structure. This results in the ability to design complex circuits in a limited amount of space while taking advantage of both electron tube and transistor technologies. Electron flow can be controlled by a signal applied either to the emitter, grid or anode.

For a three element electron tube, the plate or anode is normally operated at a potential such that essentially all the electrons that leave the emitter and pass through the control grid are collected by the anode. An increase in anode potential will increase the energy of the electrons but will do little to affect the number of electrons involved. An increase in anode potential can also increase the operating temperature of the anode and can also result in secondary electron emission from the anode. For a tubistor, no electron cloud exists near the emitter and the number of electrons (current) is determined by the field at the emitting point. This field is determined by either the field between control electrode and emitter, between anode and emitter, or some combination of these two values. This provides two bias procedures that can be used for the tubistor compared to only one for electron tubes and allows two possible inputs instead of the one input, cathode to grid, possible with electron tubes.

Figure 7:
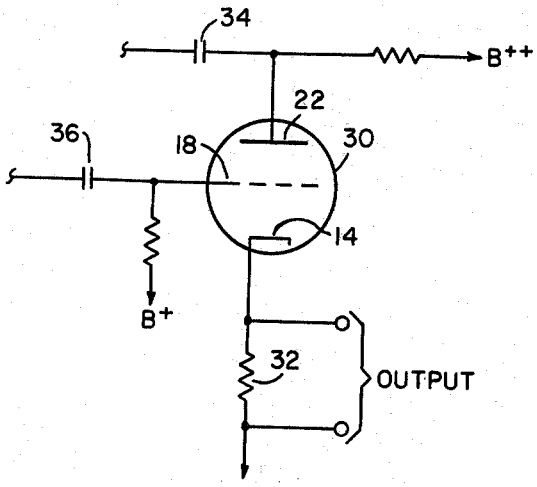
FIG. 7 is a schematic of a single stage or element of a tubistor adapted for response to anode and grid signal inputs.

FIG. 7 discloses a single tubistor 30 stage or element adapted for anode and grid signal inputs and a cathode output. Appropriate supply voltages are resistively coupled to the anode 22 and grid 18 of the tubistor, while output signals are taken from a resistance 32 in the cathode circuit. Input signals are coupled to the anode 22 through a capacitor 34, and to the grid 18 through a capacitor 36. With this arrangement the tubistor 30 may be appropriately biased such that only a signal developed across capacitor 34 is required to provide an output signal or only a signal across capacitor 36 is required to provide an output signal. Similarly, the tubistor can be biased such that the input signals developed across capacitors 34 and 36 must be coincident to establish the proper voltage relationship for current flow through the tubistor and provide an output signal.

Figure 8:
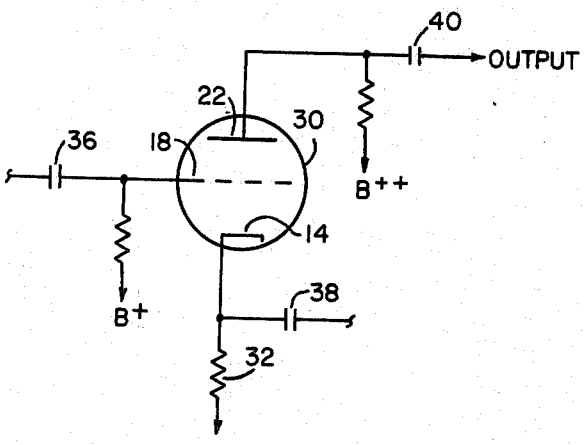
FIG. 8 is a schematic of a single stage of a tubistor adapted for response to grid and cathode signal inputs.

An alternative arrangement to that of FIG. 7 is FIG. 8 wherein the tubistor 30 is adapted to receive an input signal through capacitor 36 to the grid 18 and through a capacitor 38 to the cathode 14. A capacitor 40 is connected to the anode 22 for providing an output signal thereacross when the tubistor conducts. With similar biasing to that of the tubistor as set forth in FIG. 7, tubistor 30 may be appropriately biased so that a single input across capacitor 36 or 38 will provide the potential necessary for conduction of the tubistor to provide an output signal through capacitor 40. Similarly appropriate biasing voltages will allow coincident input signals to activate the tubistor.

To achieve substantial emission from multiple point emitters the material must be uniform and the circuit must be designed to minimize edge effects. The field effect electron emitter material has been operated for thousands of hours at current levels of 100 milliamperes per square centimeter. Final current densities of several amperes per square centimeter are expected based on presently achieved data and theoretical limitations. To achieve maximum current densities from arrays of field effect emitters, it is necessary to have both a material with the proper characteristics and a properly designed circuit.

The basic equation for single point field emitters has been developed by experimental data as have been noted by Dyke, W. T. and W. W. Dolan, in "Field Emission," Advances in Electronics and Electron Physics, volume VIII, edited by L. Martin, Academic Press, Incorporated, New York, N.Y., 1956. In its basic form, which can be quickly derived by considering concentric spheres, the equation can be written as:

$$F = K\, v/r \tag{1}$$

where K=constant, v=potential, r=radius of the emitter, and F=electric field. This basic equation can also be written as:

$$F = K \frac{\sqrt{Ac}\,\sqrt{Ae}}{4\pi r^2}\,\frac{v}{a} \tag{2}$$

where Ac=area of collector, Ae=area of emitter, and a=distance between collector and emitter. Since $4\pi r^2 = Ae$, equation 2 becomes $$F = K_1 \frac{\sqrt{Ac}}{\sqrt{Ae}}\,\frac{v}{a}\,. \tag{3}$$

Assuming that Ac is the area of the collector associated with the point directly under this area, equation (3) can be written as:

$$F = K_2 \frac{v}{a}\,\frac{l}{d} \tag{4}$$

where l=spacing between points for multiple emitting points and d=emitting point diameter.

Consideration of equation (4) in conjunction with the sharp variations in current density with small changes in electric field leads to the following conclusions concerning the material: the emitting points must be uniformly spaced, the emitting points must all have essentially the same height and diameter, and the diameter must be very small in order to operate at reasonable potentials.

The equation shows that severe edge effects will be encountered if a collector is larger than the emitting array, and that the edge effects will be more severe as the spacing is increased. This is due to the larger collector area seen by the outer most emitting points and hence the larger field present at these points. This effect can easily result in a field sufficient to damage the outer points before the field at the inner points reaches a value capable of producing emission.

Because of the very close spacing between the emitting points, a few microns, even very small extensions of the collector beyond the emitter array will result in a sharp increase in the electric field and thus a very sharp increase in current from the outer emitting points. Techniques such as the use of guard rings may possibly be used to reduce this edge effect, but this approach is complicated by the small spacing between emitting points. However by reducing the collector size such that it is smaller than the emitting array a sharp decrease in the electric field at the points not directly below the collector will result and also results in little current flow from these points. This allows the field to be increased such that all emitting points below the collector contribute to the observed current and not just a narrow ring directly below the edge of the collector.

The above equations show that not only must the field emitter material be of high quality, but that the potential of the field emitter cannot be realized using experimental techniques borrowed from thermionic emitters. Care must be exercised to insure that the electric field is uniform across the entire array of emitting points.

Because of the procedures used in fabricating the tubistor, the majority of the problems associated with field emitters are not encountered. The inverted cone around each hole and the plating techniques used assure that the spacing is constant from emitting point to anode or grid and any slight variation in emitting point distances will not affect the field since the anode and grid areas are determined by the cone size and deposition which do not vary from site to site.

Related electron emission devices are disclosed in a co-pending application having Ser. No. 864,348 and filing date of Dec. 27, 1977, and entitled "Electron Beam Forming Device" by Joe Shelton. This co-pending application was filed simultaneously with applicant's application and licensed to the US Government as represented by the Department of Army.

Although a particular embodiment and form of the invention has been described, it will be obvious to those skilled in the art that modifications may be made without departing from the scope and spirit of the invention. Accordingly, it is understood that the invention is limited only by the claims appended hereto.

I claim:

1. A field effect electron device for providing selectably controlled electron emission comprising a metal-oxide field effect electron emitter, said emitter being a plurality of metal rods in a non-conducting oxide having first and second parallel surfaces, said metal rods disposed therein at a density in excess of one million emitting rods per square centimeter of surface area, said rods being uniformly spaced in parallel for field emission of electrons from a first end thereof, each of said rods having emitting ends conically recessed below the first surface of the emitter oxide parallel surfaces; a thin film insulating layer deposited on the first surface of said emitter oxide; a thin film conductive layer deposited on said insulating layer; and said emitter rod ends and said conductive layer being disposed in respective planes separated by not more than a micron for providing rapid electron transport between said planes when a potential is applied between the emitter and the conductive layer.

2. A field effect electron device as set forth in claim 1 and further comprising a second insulator deposited on the surface of said conductive layer and a collector supported by said second insulator, said collector being spaced within one micron of the emitting tips of said metal rods for providing a short transit time for electron transfer from emitter to collector and thereby permitting a high range of operating frequencies.

3. A field effect electron device as set forth in claim 2 and further comprising first means coupled to said collector for selectively supplying an input trigger signal thereto, a second means coupled to said conductive layer for selectably providing a grid trigger signal thereto, a third means coupled to said emitter rods for developing an output signal thereacross in response to selectable grid and collector trigger signal inputs.

4. A field effect electron device as set forth in claim 3 and further comprising a fourth means coupled to said emitter rods for selectably providing an emitter trigger signal thereto and a fifth means coupled to said collector for developing an output signal thereacross in response to selectable grid and emitter trigger signal inputs.

5. A field effect electron device as set forth in claim 2 and further comprising first means coupled to said conductive layer for providing a grid trigger signal thereto, a second means coupled to said emitter rods for selectably providing emitter trigger signals thereto and a third means coupled to said collector for developing an output signal thereacross in response to grid or emitter input signals.

6. A field effect electron device as set forth in claim 2 and further comprising an insulating grid network disposed on the second surface of said metal-oxide emitter parallel surfaces for providing a plurality of isolated emitter sections; a conducting material disposed within each of said isolated sections for providing electrical contact with the emitting rods adjacent respective sections and thereby providing a plurality of individual emitters within a single electron device.

7. A field effect electron device as set forth in claim 6 and further comprising first means coupled to said conductive layer for providing a grid trigger signal thereto, a second means coupled to said emitter rods for selectably providing emitter trigger signals thereto and a third means coupled to said collector for developing an output signal thereacross in response to grid or emitter input signals.

8. A field effect electron device as set forth in claim 6 wherein said conductive layer is segmented for providing a plurality of isolated grid sections disposed adjacent selective isolated emitter sections and thereby providing a plurality of individual emitters and grids within a single electron device.

9. A field effect electron device as set forth in claim 8 wherein said collector is segmented for providing a plurality of isolated collectors each disposed for receiving field effect electron flow from plural emitters for providing integrating and multiplexing of input signals.

* * * * *